US005156238A

United States Patent [19]

Matthews

[11] Patent Number: 5,156,238

[45] Date of Patent: Oct. 20, 1992

[54] PORTABLE SURFACE LIFT FOR A VEHICLE

[75] Inventor: Curtis J. Matthews, Germantown, Tenn.

[73] Assignee: Delaware Capital Formation, Inc., Wilmington, Del.

[21] Appl. No.: 793,167

[22] Filed: Nov. 18, 1991

[51] Int. Cl.[5] ..... B66F 7/08

[52] U.S. Cl. ..... 187/8.72; 187/8.65; 187/9 R; 254/89 R; 254/2 R

[58] Field of Search ..... 187/9 R, 8.65, 8.72; 254/89 R, 89 H, 90, 92, 2 R; 5/86.1, 600, 611; 16/44

[56] References Cited

U.S. PATENT DOCUMENTS

| | | | |
|---|---|---|---|
| 281,299 | 7/1883 | Roberts et al. | 16/44 |
| 2,800,320 | 7/1957 | Jarrett et al. | 16/44 X |
| 2,955,645 | 10/1960 | Cramer | 182/107 X |
| 3,096,536 | 7/1963 | Rabelos | 16/44 X |
| 3,117,765 | 1/1964 | Chiuzzi | 254/10 |
| 3,298,705 | 1/1967 | Neaverson et al. | 254/2 R X |
| 3,317,004 | 5/1967 | Harrison | 187/8.5 |
| 3,689,030 | 9/1972 | Backus | 254/93 |
| 4,099,695 | 7/1978 | Shinn | 16/44 X |
| 4,445,665 | 5/1984 | Cray | 254/88 |
| 4,497,501 | 2/1985 | Kedem | 254/2 R X |
| 4,573,552 | 3/1986 | Aoki | 187/8.72 X |
| 4,763,910 | 8/1988 | Brändli et al. | 16/44 X |
| 4,901,980 | 2/1990 | Hansen | 254/9 C |
| 5,025,892 | 6/1991 | Stelzl | 187/8.72 |

OTHER PUBLICATIONS

Rotary Lift, A Dover Industries Co., "The PFX And PAL7 Do Wonders For Brake And Tire Work" (1991).

*Primary Examiner*—Robert P. Olszewski
*Assistant Examiner*—Dean A. Reichard
*Attorney, Agent, or Firm*—Walker, McKenzie & Walker

[57] ABSTRACT

A portable surface lift for a vehicle and retractable spring-loaded wheels attached to the lift for rolling the lift over a garage floor surface when the vehicle is not lifted on the lift. The lift has various adaptor pads for contact with the undercarriage of the vehicle, and a hydraulic cylinder raises and lowers the vehicle on the lift. The spring-loaded wheels extend and raise the lift from the floor for movement when a vehicle is not on the lift, and retract to allow the lift to rest on the floor when the vehicle is lifted. Three towing mechanisms are provided for moving the lift: a bar that can be attached to an automobile floor jack, a towing dolly, and a towing apparatus. The towing apparatus allows a towing bracket on the end of the lift's base to be reached beneath a long luxury vehicle. The lift may be rolled under and from a stationary vehicle, and has a safety locking mechanism for securing the lift in various raised positions.

13 Claims, 4 Drawing Sheets

PORTABLE SURFACE LIFT FOR A VEHICLE

BACKGROUND OF THE INVENTION

1. Field of the Invention

The present invention relates, in general, to lifts for vehicles, and in particular, to low-rise surface lifts for vehicles.

2. Information Disclosure Statement

Establishments or shops where vehicles, such as cars, trucks, and the like, are serviced often need to raise the vehicles from the surface of the shop floor to facilitate the tasks to be performed by a service attendant or mechanic. In many applications, such as vehicle body repair, tire rotation, brake servicing, as well as new and used vehicle preparation and reconditioning, the desired height that a vehicle must be lifted is quite limited, i.e., only to the waist or chest of the repair person. For such applications, use of a "low-rise" surface-mounted lift, as distinguished from a hydraulic lift with a below-ground buried lifting cylinder, is well-known. Such surface-mounted low-rise lifts are typically bolted to the surface of the floor of a service bay in a garage.

A representative well-known example of such a surface-mounted low-rise lift is the model PAL7 surface-mounted low-rise parallelogram lift manufactured and sold for many years by Rotary Lift Company, Memphis, Tenn. The PAL7 lift is designed with parallel front and rear supporting legs pivotally attached to a base and a superstructure, with a hydraulic cylinder that raises and lowers the superstructure and associated vehicle support arms.

However, as such surface-mounted lifts are bolted to the floor of the garage bay, their use is limited to "dedicated bay" applications. A significant capital investment, sufficient to outfit each garage bay with its own dedicated and permanently mounted lift, has been heretofore required by the buyer of surface-mounted lifts.

It is therefore desirable to have a portable surface lift for a vehicle that may be easily moved from garage bay to garage bay, as required, thereby reducing the number of surface lifts required by a given establishment, yet which remains stable beneath a vehicle when in use. Rather than requiring wheels to be attached and removed every time the lift is moved, the lift should be able to be moved into place, preferably moving under a stationary vehicle, yet remain safely in position and not move when lifting that vehicle. It is also desirable to have towing means removable from the lift for moving the lift from one location to another.

A preliminary patentability search in Class 254, subclasses 10C, 8C, 9C, 90, and 124 in the Examiner's Group produced the following patents, some of which may be relevant to the present invention: Chiuzzi, U.S. Pat. No. 3,117,765, issued Jan. 14, 1964; Backus, U.S. Pat. No. 3,689,030, issued Sep. 5, 1972; Cray, U.S. Pat. No. 4,445,665, issued May 1, 1984; and Hansen, U.S. Pat. No. 4,901,980, issued Feb. 20, 1990.

Additionally, Harrison, U.S. Pat. No. 3,317,004, issued May 2, 1967, describes a surface-mounted low-rise parallelogram lift with a releasable safety locking mechanism.

While each of the above patents disclose various vehicle lifts, none disclose or suggest the present invention. More specifically, none of the above patents disclose or suggest, in combination, a portable surface lift for a vehicle, and retractable wheel means, including spring biasing means, attached to the lift for rolling movement of the lift over a surface, such as a garage floor, nor disclose or suggest, in combination with such a portable lift, towing means, removably attachable to an end of the lift, for lifting the end of the lift from resting on the garage floor surface and for causing the lift to be rollingly moved.

Chiuzzi, U.S. Pat. No. 3,117,765, describes a wheeled parallelogram geometry lifting device, but shows no retractable wheel means.

Backus, U.S. Pat. No. 3,689,030, describes a wheeled frame straightening machine having a caster at the end of a spring-loaded beam, but does not show the lifting of cars or other vehicles.

Cray, U.S. Pat. No. 4,445,665, describes a trailer-mounted lift having hydraulically extendable wheels, but teaches, at column 6, the removal of the wheels when the lift is used in a garage. Unlike the present invention, the Cray patent cannot allow its lift to collapse to a low height and be wheeled under and from a stationary vehicle.

Hansen, U.S. Pat. No. 4,901,980, describes a portable lift that folds into a trailer configuration having removable wheels with leaf springs. Unlike the present invention, vehicles cannot be raised and lowered on the Hansen device with the wheels attached.

SUMMARY OF THE INVENTION

The present invention is, in combination, a portable surface lift for a vehicle, and retractable wheel means attached to the lift for rolling movement of the lift over a garage floor surface. The wheel means includes spring biasing means for allowing the lift to be in resting contact with the surface when a vehicle is lifted on the lift, and for raising the lift from resting contact with the surface by extending a wheel from the lift toward the surface when a vehicle is not lifted upon the lift. Additionally, the present invention may include one of a variety of towing means, removably attachable to an end of the lift, for lifting the end of the lift from the surface and for causing the lift to be rollingly moved.

It is an object of the present invention to provide portability for a surface vehicle lift. It is also desirable, for safety reasons, that the lift not be prone to movement over the surface on which the lift rests when a vehicle is lifted thereon. It is a further object that removable towing means be provided for moving the lift over its resting surface, and that the towing means preferably be attachable and detachable from the lift when the lift is lowered beneath a vehicle so that the lift may be placed under and removed from a stationary vehicle.

DESCRIPTION OF THE PREFERRED EMBODIMENT

Figure 1:
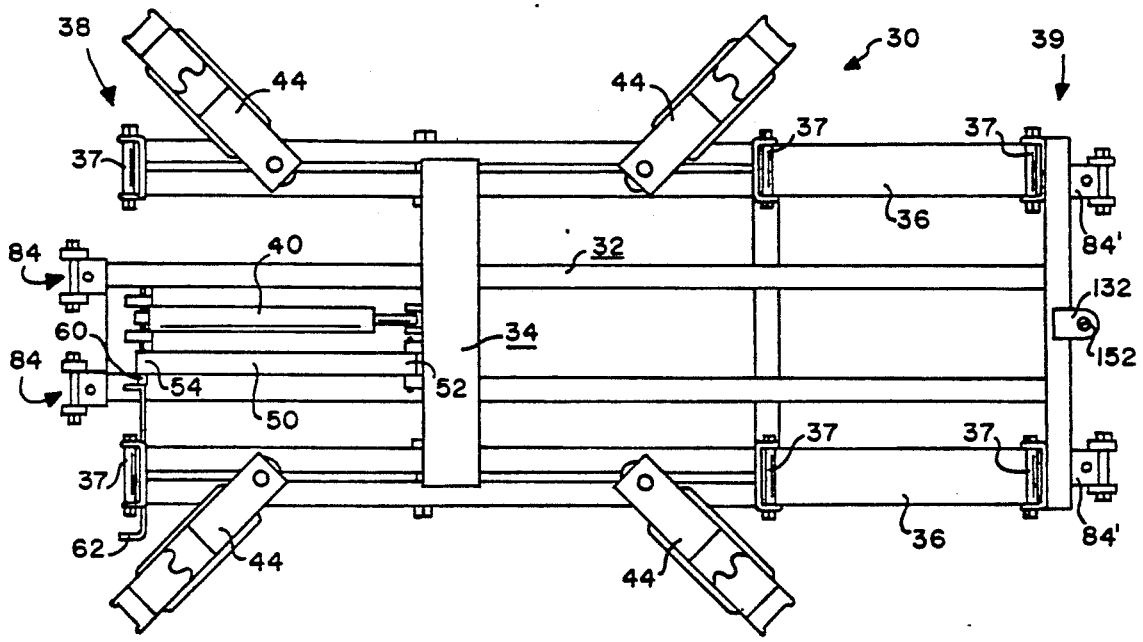
FIG. 1 is a plan view of the portable surface lift of the present invention with wheel means at both ends of the base.

Referring to FIGS. 1, 2, 3, and 12, the portable surface lift 30 is seen to comprise a base 32, a superstructure 34, plus front and rear legs 35, 36 pivotally attached using hinge bushings 37 at either ends thereof to base 32 and superstructure 34, thereby forming a parallelogram. For reference purposes, lift 30 will be understood to have a front end 38 and a rear end 39, corresponding to the front and rear ends, respectively, of a vehicle to be supported by lift 30. A hydraulic cylinder 40 having a piston or cylinder rod 42 is pivotally attached between base 32 and superstructure 34 to cause raising and lowering of superstructure 34 in response to the extension and retraction of cylinder rod 42 in a manner well-known to those skilled in the art. If desired, a protective cylinder rod cover 43 may cover cylinder rod 42 to protect against paint overspray onto cylinder rod 42 as might otherwise occur when a vehicle is being painted. The parallelogram design geometry of lift 30 is understood to cause superstructure 34 to remain substantially parallel to base 32 at all times.

Superstructure 34 typically has four swivel arms 44, slidable and pivotable in the horizontal plane, attached to superstructure 34 for supporting a vehicle upon the lift in the usual and well-known manner. Swivel arms 44 may each have adaptor pads 46 for meeting with various undercarriage surfaces of the vehicle to be lifted, and may assume either a flat position 47 shown in FIG. 2, a "low step" position 48 shown in FIG. 3, or a "high step" position 49 also shown in FIG. 3, for contact with the vehicle as required, all well-known to those skilled in the art.

Figure 12:
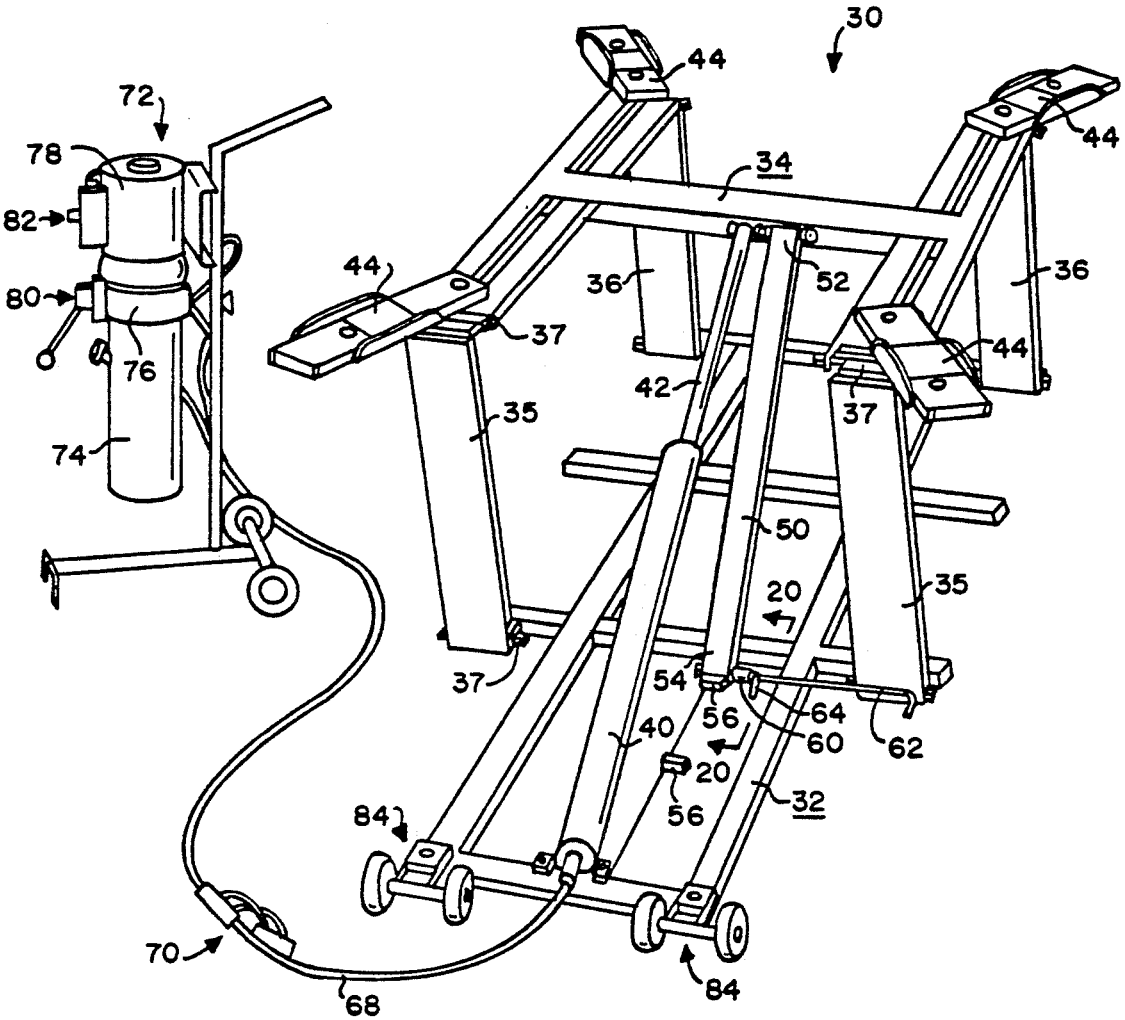
FIG. 12 is a perspective view of the portable surface lift in the raised position and attached to a portable power unit.

Turning to FIG. 12, lift 30 also has, for safety reasons, a locking leg 50 hingedly attached at one end 52 to superstructure 34 and slidably resting at the other end 54 upon base 32. One or more stop blocks 56 are fixedly attached, as by welding, to base 32 in the sliding path of end 54. As superstructure 34 is raised by hydraulic cylinder 40, end 54 of locking leg 50 will be dragged up and over each stop block 56 in a manner that will now be apparent. However, it will be understood that locking leg 50 will prevent superstructure 34 from lowering when end 54 abuts against edge 58 of a stop block 56 as shown in detail in FIG. 20.

Figures 15, 16, 17, 18, 19, 20:
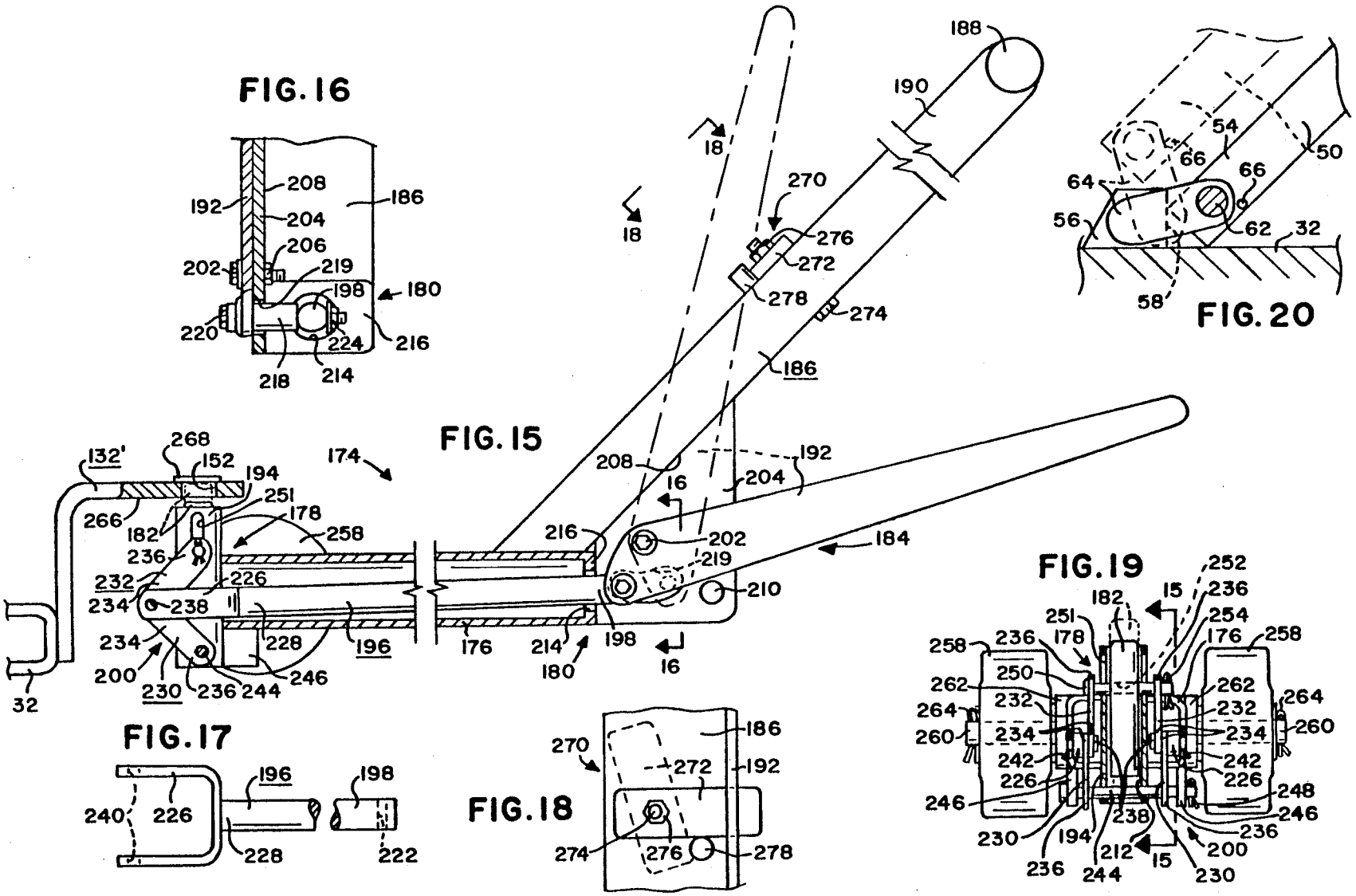
FIG. 15 is a side elevational and partially sectional view of the towing apparatus or third embodiment of the towing means of the present invention, taken substantially along the line 15—15 shown in FIG. 19.
FIG. 16 is a rear end sectional view of the towing apparatus showing connection of the lever and handle to the horizontal tube and pull rod linkage, taken along the line 16—16 shown in FIG. 15.
FIG. 17 is a top plan view of the pull rod linkage of the towing apparatus.
FIG. 18 is a top plan view of the keeper means of the towing apparatus, taken along the line 18—18 shown in FIG. 15, with the lever in the engaging position.
FIG. 19 is a front end view of the towing apparatus, with a section of the guide tube removed, showing the movement of the vertical towing and lifting pin.
FIG. 20 is a side sectional view through the locking latch release handle of the portable surface lift, showing the movement of the cam leg at the end of the locking leg, taken substantially along the line 20—20 shown in FIG. 12.

Fixedly attached, as by welding, to the lower end 54 of locking leg 50, is a sleeve 60. Rotatably attached through sleeve 60 is a locking latch release handle 62 having a fixedly attached cam leg 64 radially extending therefrom adjacent sleeve 60. When the operator of lift 30 desires to lower superstructure 34, locking latch release handle 62 will be turned counterclockwise so that cam leg 64 lifts end 54 of locking leg 50 over stop block 56 as shown in FIG. 20 in dotted outline. A stop 66 extends outwardly from locking leg 50 for allowing cam leg 64 to rest in an over-center locking position, thereby holding end 54 of locking leg 50 above stop block 56 during lowering of superstructure 34. When superstructure 34 is again raised, cam leg 64 will rotate clockwise and allow end 54 of locking leg to drop to base 32, for contact with stop blocks 56, in a manner that will now be apparent.

Referring to FIG. 12, hydraulic cylinder 40 is connected, as by hose 68 having well-known quick disconnect couplings 70, to a portable power unit 72. Power unit 72 includes a hydraulic fluid reservoir 74 and a hydraulic pump 76 driven by an air or electric motor 78. Typically, motor 78 will be air driven for safety in environments having flammable solvents or paints. Various valves 80 and switches 82 control pump 76 and motor 78 for operating hydraulic cylinder 40 in a manner well-known to those skilled in the art.

For portability, lift 30 includes retractable spring-loaded wheel means 84 attached to one of front and rear ends 38, 39 of lift 30 for rolling movement of lift 30 over the garage surface. Referring to FIGS. 4–9, the details of the preferred embodiment of wheel means 84 are shown. Wheel means 84 includes a wheel arm 86 having a first and a second end 88, 90, respectively, with first end 88 being pivotally attached, as by pivot pin 92 through holes 94 in arm 86, to mounting bracket 96 and holes 98 therethrough. Bracket 96, preferably constructed as a pair of gussets 95 welded to an L-shaped member 97, is fixedly attached, as by welding, to said one of said front and rear ends 38, 39 of base 32, preferably to front end 38 as shown. The attachment of bracket 96 to base 32 may be reinforced by one or more gussets 100 welded between bracket 96 and base 32. Pivot pin 92 preferably is secured within holes 94, 98 by well-known "push-on" nuts 102.

Wheel means 84 also includes a wheel 104 and preferably two such wheels 104, mounted upon an axle bolt 106 that, in turn, is attached to second end 90 of wheel arm 86 as by passing through holes 108 therethrough. Axle bolt 106 will be understood to rotatably secure wheels 104 to wheel arm 86 using, for instance, nut 110, and wheel 104 is seen to be in rolling contact with the garage floor surface S on which lift 30 rests. Wheel arm 86 preferably has a support strut 112 spanning, rigidly separating, and preferably welded to left and right sides 114, 116 of wheel arm 86.

Wheel means 84 further includes spring biasing means 118 for allowing base 32, and hence lift 30, to be in resting contact with garage floor surface S when a vehicle is lifted on lift 30, and for raising lift 30 from resting contact with surface S by extending wheel 104 from lift 30 toward surface S when a vehicle is not lifted upon lift 30. In the preferred embodiment, spring biasing means 118 is provided for causing wheel arm 86 to pivot when the weight of a vehicle is removed from lift 30, so that the one end, 38 or 39, of base 32 to which wheel means 84 is attached, is lifted off surface S. Spring biasing means 118 will be understood to be sufficient to overcome the weight of lift 30 alone, without a vehicle lifted thereon, but not sufficient to overcome the combined weight of lift 30 and a vehicle, thereby allowing wheel arm 86 to pivot when a vehicle is lifted upon lift 30 so that the one end, 38 or 39, of base 32 to which wheel means 84 is attached, lowers to meet surface S for resting contact thereon. In this manner, base 32 is prevented from rolling movement over surface S when a vehicle is lifted upon lift 30. It shall be understood that, while the preferred embodiment has wheel means 84 only at one end of base 32 so that lift 30 does not move about on the garage floor surface when no vehicle is lifted on lift 30 due to the resting of the other end of base 32 upon the garage floor surface, there may be an additional and substantially similar wheel means 84' at the other end of base 32 as well, as shown in FIG. 1. It is desirable that lift 30 not move before a vehicle is lifted thereon so that the alignment of swivel arms 44 with the undercarriage of the vehicle remain positioned properly until the vehicle is on the lift. Both wheel means 84 and 84' include spring biasing means 118 to raise and lower their respective ends of base 32 as the weight of a vehicle is removed from and lifted by lift 30.

In the preferred embodiment, spring biasing means 118 includes a compression spring 120 exerting force between bracket 96 and spring plate 122 welded to wheel arm 86. A bolt 124 passing coaxially through spring 120 and through enlarged holes 126 and 128 in bracket 96 and spring plate 122, respectively, and secured by nut 130, holds spring 120 in position and limits the counterclockwise rotation, as viewed in FIG. 5, of wheel arm 86 about pivot pin 92, thereby limiting the lifting action by wheel arm 86 of base 32, while still allowing arm 86 to pivot clockwise, compress spring 120, and lower base 32 into resting contact with surface S when a vehicle's weight is lifted by lift 30.

For towing lift 30 across the garage floor surface, one of a variety of towing means may be provided for removable attachment to an end of the lift. The term "towing," as used herein, shall be understood to encompass both pushing and pulling of lift 30 across the garage floor surface. A towing bracket 132 is fixedly attached, as by welding, to lift 30 at an end thereof for removable engagement with the towing means.

Figure 10:
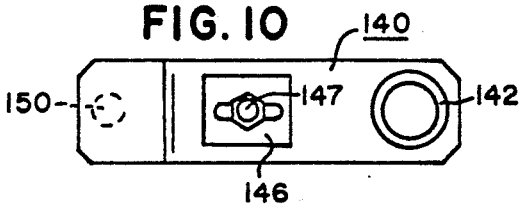
FIG. 10 is a bottom view of the jack bracket bar of a first embodiment of the towing means of the present invention, taken along the line 10—10 shown in FIG. 11.
Figure 11:
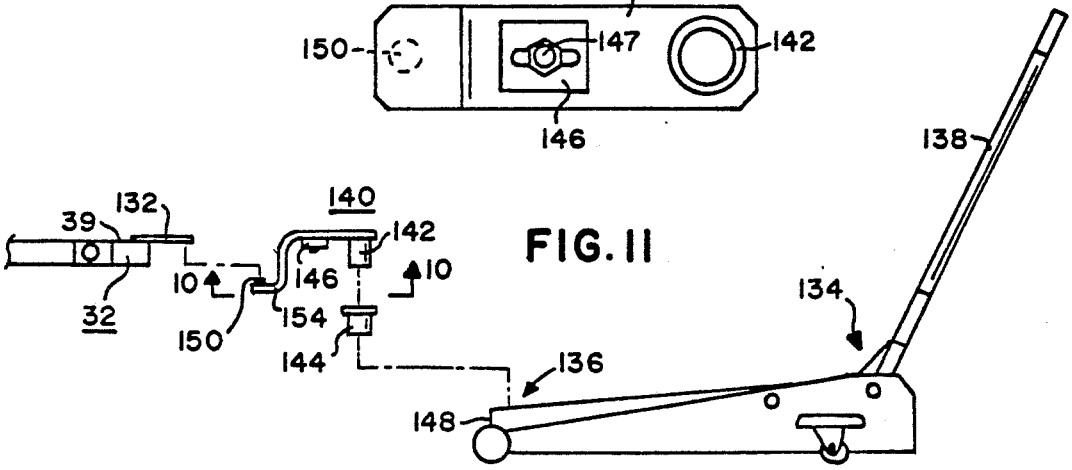
FIG. 11 is a side elevational view of the first embodiment of the towing means of the present invention showing attachment of the towing bracket of the lift to the towing means.

In the first embodiment shown in FIGS. 10 and 11, the towing means is selected to be a modified automotive floor jack 134 having a manually-operated lifting portion 136 that lifts and lowers a load in response to operation of handle 138 in a manner well-known to those skilled in the art. Typically, an unmodified and well-known floor jack will have a scalloped lifting dish, not shown, having a downward extending pin inserted into a socket in lifting portion 136. By removing the lifting dish the socket will be exposed, and jack bar 140 can then be attached to lifting portion 136 by inserting pin 142, typically 1-½ inches in diameter and closely matching the size of the socket, of jack bar 140 into the socket. If the socket in lifting portion 136 is larger than the standard size accommodated by pin 142, as some sockets may be an adapter 144 may be provided for reducing the size of the socket to that of pin 142. A slotted plate 146, adjustably secured to jack bar 140 by screw and nut 147, can then be adjusted to snugly abut against front edge 148 of floor jack 134 and cause jack bar 140 to fixedly and outwardly extend from floor jack 134 with negligible horizontal angular movement about pin 142. Jack bar 140 also has an engaging pin 150 for removable engagement with hole 152 in towing bracket 132. Preferably, jack bar 140 is shaped with a portion 154 that extends downwardly from the collapsed height of lifting portion 136 to a position nearer the garage floor surface, and engaging pin 150 is welded to portion 154, thereby allowing towing bracket 132 to be of a low height off the garage floor and yet still allow engagement with pin 150 which must slide under towing bracket 132 during engagement and disengagement therewith. Once pin 150 is positioned for engagement with hole 152, lifting portion 136 of floor jack 134 may be raised, thereby engaging and lifting towing bracket 132 for towing of lift 30.

Figure 13:
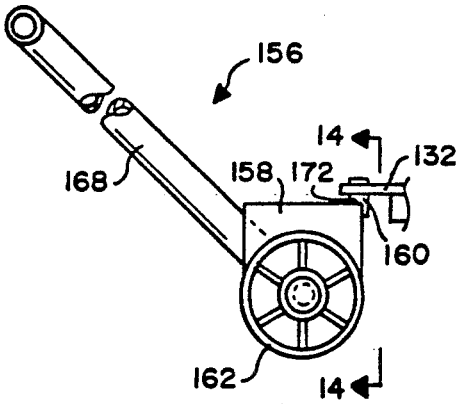
FIG. 13 is a side elevational view of the towing dolly or second embodiment of the towing means of the present invention, showing attachment of the towing bracket of the lift to the towing dolly.
Figure 14:
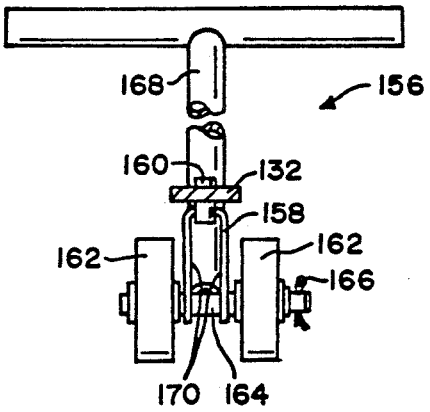
FIG. 14 is a front elevational view of the towing dolly, taken along the line 14—14 shown in FIG. 13.

In the second embodiment of the towing means, shown in FIGS. 13 and 14, a towing dolly 156 may be selected instead of the aforementioned modified automotive floor jack. Towing dolly 156 includes a dolly bracket 158 and engagement means, such as pin 160 welded to dolly bracket 158, for removable engagement with towing bracket 132. Towing dolly 156 also includes one or more wheels 162 attached for rotation to dolly bracket 158 as by axle clevis pin 164 secured by cotter pin 166, and further includes a handle 168 attached, as by welding at points 170, to dolly bracket 158 for movement thereof. It shall be understood that by lifting handle 168, pin 160 will drop downwardly for sliding under bracket 132. When pin 160 is aligned with hole 152 in bracket 132, handle 168 can be lowered, thereby raising pin 160 for engagement with bracket 132 and causing bracket 132 to rest on and be lifted by portion 172 of dolly bracket 158, allowing lift 30 to be towed by towing dolly 156 in a manner that will now be apparent.

In a third embodiment of the towing means, shown in FIGS. 15–19, a towing apparatus 174 may be selected instead of the aforementioned towing dolly or modified automotive floor jack. Towing apparatus 174 comprises an elongated and substantially horizontal tube 176 having a first end 178 and a second end 180, a vertical towing pin 182 slidably attached to first end 178 for removable engagement with towing bracket 132', actuating means 184 for raising and lowering vertical pin 182, and a handle 186 attached to second end 180 for movement of towing apparatus 174 across garage floor surface S. Handle 186 may have a horizontal grip portion 188 welded to handle shaft 190 at the center of grip portion 188 for grasping by an operator.

In the preferred embodiment, actuating means 184 comprises a lever 192 pivotally attached to second end 180 of horizontal tube 176, a guide tube 194 fixedly and preferably weldedly attached to first end 178 of horizontal tube 176, a pull rod linkage 196 having a first end 198 operably connected to lever 192 for longitudinal movement of pull rod linkage 196 in response to pivotal movement of lever 192, and translating means 200 for translating the longitudinal movement of pull rod linkage 196 into vertical movement of vertical towing pin 182.

Preferably, lever 192 is pivotally attached to second end 180 of horizontal tube 176 by a bolt 202 passing through a hole in lever 192 and a matching hole in gusset 204, secured by nut 206. Gusset 204 is welded to handle 186 along seam 208 and to second end 180 of horizontal tube 176 for providing structural rigidity to handle 186 and for providing a rigid pivot point, i.e., bolt 202, about which lever 192 pivots. Gusset 204 may have a stop bolt or post 210 extending outwardly therefrom to limit the movement of lever 192.

Guide tube 194 has a longitudinal bore 212 therethrough within which vertical towing pin 182 slides up and down. First end 198 of pull rod linkage 196 extends through opening 214 of bulkhead 216 welded to second end 180 of horizontal tube 176. First end 198 of pull rod linkage 196 is operably connected to lever 192 by a tube 218 welded to lever 192 and passing through slot 219 of gusset 204. Furthermore, a bolt 220 passes through lever 192, tube 218 (and, therefore, gusset 204), hole 222 in first end 198 of pull rod linkage 196, and is threadedly secured by nut 224. It will now be understood that pivotal movement of lever 192 about bolt 202 causes longitudinal movement of pull rod linkage 196 because of the operable interconnection of pull rod linkage 196 with lever 192 by bolt 220.

In the preferred embodiment, pull rod linkage 196 has a clevis 226 attached, as by welding, to second end 228 thereof, and translating means 200 includes a first link member 230 and a second link member 232, and preferably a pair each of first and second link members 230 and 232. Each link member, 230, 232 has a first end 234 and a second end 236. First ends 234 of link members 230 and 232 are operably connected, as by short clevis pin 238 through hole 240 in clevis 226 anchored by cotter pin 242, to second end 228 of pull rod linkage 196. Also, second end 236 of first link member 230 is pivotally attached to guide tube 194 as by long clevis pin 244 through guide tube 194 and end 236 of first link member 230 and further preferably through lower pivot support 246 welded to horizontal tube 176, with cotter pin 248 securing clevis pin 244 in position. Finally, second end 236 of second link member 232 is pivotally attached to vertical towing pin 182, as by intermediate clevis pin 250 passing through both vertical slot 251 in guide tube 194 and transverse hole 252 through vertical pin 182 to second end 236 of second link 232, secured by cotter pin 254.

It shall be understood that the aforementioned interconnected structure of first and second link members 232, 230 is preferably repeated on either side of guide tube 194 as shown in FIG. 19 to both prongs of clevis 226. It will now be apparent that, as pull rod linkage 196 moves longitudinally, it will cause end 236 of second link member 232 to move vertically toward and apart from end 236 of first link member 230, thereby lowering and raising vertical towing pin 182.

Towing apparatus 174 also has a wheel and preferably a pair of wheels 258 attached for rotation to towing apparatus 174 for rolling support thereof, as by axle 260 outwardly extending from disk 262 welded to horizontal tube 176. A cotter pin 264 secures wheels 258 to axle 260.

Figure 2:
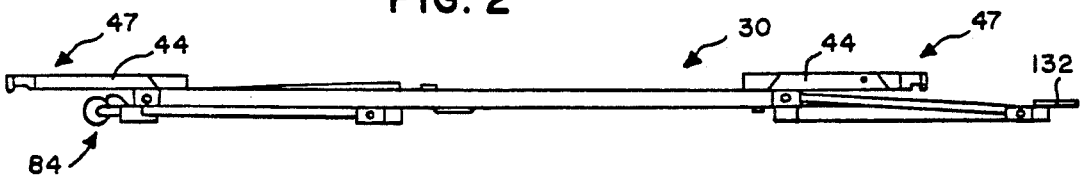
FIG. 2 is a side elevational view of the portable surface lift of the present invention shown in its lowered or collapsed position, with wheel means at one end only of the base.
Figure 3:
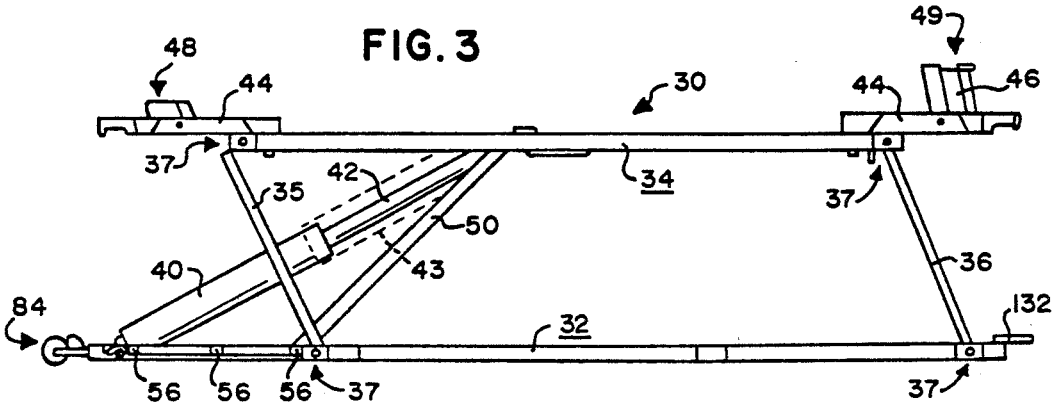
FIG. 3 is a side elevational view, similar to FIG. 2, but with the portable surface lift shown in a raised position.
Figure 4:
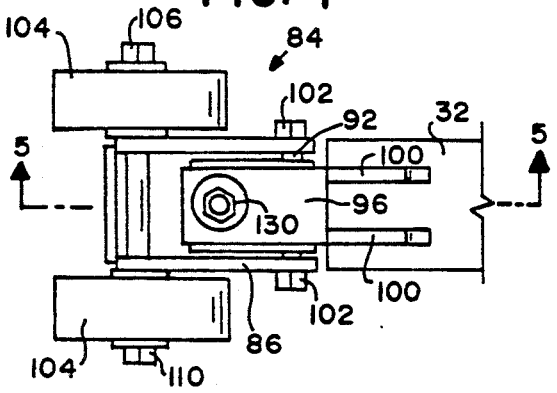
FIG. 4 is a top view of the wheel means of the present invention.
Figure 5:
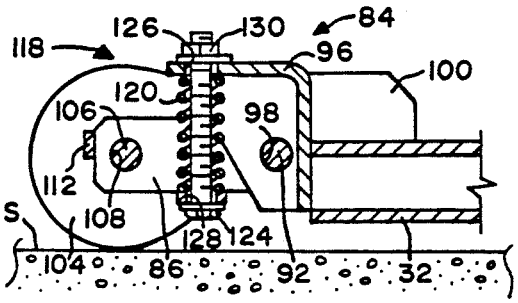
FIG. 5 is a side sectional view of the wheel means of the present invention, taken along the line 5—5 shown in FIG. 4.
Figure 6:
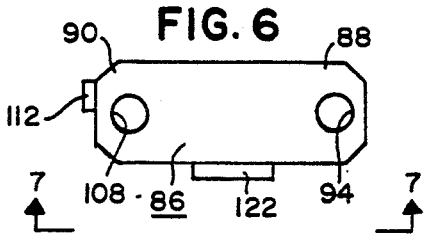
FIG. 6 is a side elevational view of the wheel arm of the wheel means.
Figure 8:
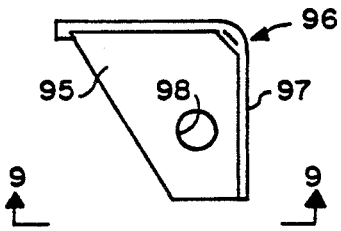
FIG. 8 is a side view of the mounting bracket of the wheel means.
Figure 7:
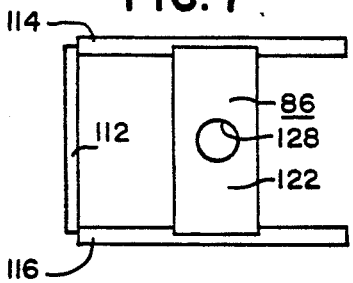
FIG. 7 is a bottom view of the wheel arm, taken along the line 7—7 shown in FIG. 6.
Figure 9:
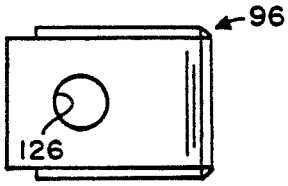
FIG. 9 is a top view of the mounting bracket, taken along the line 9—9 shown in FIG. 8.

When the invention is configured with towing apparatus 174 in the third embodiment of the towing means, towing bracket 132 shown in FIGS. 1-3 will be modified slightly to be as towing bracket 132' shown in FIG. 15 partially sectioned for clarity in describing the construction thereof. Towing bracket 132' will have its horizontal portion 266 raised slightly from that shown in FIGS. 2 and 3 to create clearance for towing apparatus 174 and guide tube 194. A circular plate 268 welded to the upper surface of horizontal portion 266 creates a blind hole out of hole 152 in towing bracket 132', allowing vertical pin 182, when raised, to lift plate 268, thereby lifting base 32 from the garage floor surface, for towing of the portable lift. It shall be understood that, by appropriately dimensioning dolly bracket 158 of towing dolly 156 to extend a greater distance from the garage floor, or by making downward extending portion 154 of jack bar 140 less downwardly extending, the first and second embodiments of the towing means could be used with towing bracket 132' as well.

Finally, towing apparatus 174 also preferably includes keeper means 270 for securing lever 192 in an engaging position in which vertical towing pin 182 is raised, shown in dotted outline in FIG. 15, as contrasted to a disengaging position in which vertical towing pin 182 is lowered, shown in solid outline in FIG. 15. Keeper means 270 preferably includes a pivotable keeper bar 272 having a locked position shown in solid outline in FIG. 18, and also having an unlocked position shown in dotted outline in FIG. 18. Keeper bar 272 rotates about a bolt 274 secured through handle shaft 190 by nut 276, and a stop or post 278, outwardly extending from handle shaft 190, is provided for holding keeper bar 272 in the locked position. To operate the actuating means 184, the user rolls towing apparatus 174 into position with vertical pin 182 in alignment with hole 152, places keeper bar 272 in the unlocked position, raises lever 192 into the engaging position, then rotates keeper bar 272 into the locked position beneath lever 192, thereby preventing lever 192 from falling. The lift 30 can now be moved, as vertical pin 182 will be engaged with hole 152.

Three embodiments of the towing means are provided to accommodate the various requirements of lift users. For those persons already owning a portable floor jack, the first embodiment, which merely requires the addition of a jack bar bracket 140 to an existing floor jack, minimizes capital outlay. For those persons without a portable floor jack, towing dolly 156 perhaps is the cheapest towing solution. However, some luxury cars that will be lifted on lift 30 will extend a substantial and not insignificant distance past base 32 at front and rear ends 38, 39, making it impossible for the first or second towing means embodiments to reach bracket 132 under the extended vehicle rear end over end 39 of lift 30. Although lift 30 could still be moved using the first or second towing means embodiments if the vehicle were not present, in some situations it is desirable to move lift 30 into or out of position under a stationary long luxury vehicle. It is for this latter situation, to accommodate the otherwise inaccessible towing bracket, that the third towing means embodiment is provided.

Although the present invention has been described and illustrated with respect to a preferred embodiment and a preferred use therefor, it is not to be so limited since modifications and changes can be made therein which are within the full intended scope of the invention.

I claim:

1. In combination, a portable surface lift for a vehicle and retractable wheel means attached to said lift for rolling movement of said lift over a surface when said vehicle is not lifted upon said lift, said lift comprising: a base; a superstructure; a front leg and a rear leg, each said leg being substantially the same length and having an upper and a lower end, said lower end of said front leg being pivotally attached to said base and said upper end of said front leg being pivotally attached to said superstructure, said lower end of said rear leg being pivotally attached to said base and said upper end of said rear leg being pivotally attached to said superstructure so that respective portions, defined to span the distance between the pivotal attachments of said front and said rear legs, of said base and said superstructure form horizontally parallel opposite sides of a parallelogram and so that said front and said rear legs form parallel opposite sides of said parallelogram, said portions of said superstructure and said base being longer than said legs; said wheel means comprising: a wheel rolling contact with said surface, and spring biasing means for allowing said lift to be in resting contact with said surface when said vehicle is lifted on said lift, and for raising said lift from said resting contact with said surface by extending said wheel from said lift toward said surface when said vehicle is not lifted upon said lift.

2. In combination, a portable surface lift for a vehicle, said lift having a front end and a rear end, and retractable wheel means attached to one of said front and rear ends of said lift for rolling movement of said lift over a surface, said wheel means comprising:

(a) a wheel arm having a first and a second end, said wheel arm being pivotally attached at said first end thereof to said one end of said lift;

(b) a wheel rotatably attached to said second end of said wheel arm and in rolling contact with said surface; and (c) spring biasing means for causing said wheel arm to pivot when said vehicle is removed from said lift so that said one end of said lift is lifted off said surface.

3. In combination, (a) a portable surface lift for a vehicle, said lift having a front end and a rear end;

(b) retractable wheel means attached to one of said front and rear ends of said lift for rolling movement of said lift over a surface, said wheel means comprising:

i. a wheel arm having a first and a second end, said wheel arm being pivotally attached at said first end thereof to said one end of said lift;

ii. a wheel rotatably attached to said second end of said wheel arm and in rolling contact with said surface; and iii. spring biasing means for causing said wheel arm to pivot when said vehicle is removed from said lift so that said one end of said lift is lifted off said surface; and (c) towing means, removably attachable to the other of said front and rear ends of said lift, for towing said other end of said lift.

4. The apparatus as recited in claim 3, in which said lift includes a towing bracket fixedly attached to said other end of said lift, and in which said towing means is removably attachable to said towing bracket and is selected from the group consisting of:

(a) a modified automotive floor jack, said jack comprising a manually-operated lifting portion and a jack bracket bar securedly attached to said lifting portion for removable engagement with said towing bracket;

(b) a towing dolly, said towing dolly comprising:

i. a dolly bracket;

ii. engagement means attached to said dolly bracket for removable engagement with said towing bracket;

iii. a wheel attached for rotation to said towing dolly for rolling support of said towing dolly; and iv. a handle attached to said towing dolly for movement of said towing dolly; and (c) a towing apparatus, said towing apparatus comprising:

i. an elongated and substantially horizontal tube having a first end and a second end;

ii. a vertical towing pin slidably attached to said first end of said horizontal tube for removable engagement with said towing bracket;

iii. actuating means for vertical raising and lowering movement of said vertical pin;

iv. a wheel attached for rotation to said towing apparatus for rolling support of said towing apparatus; and v. a handle attached to said second end of said horizontal tube for movement of said towing apparatus.

5. The apparatus as recited in claim 3, in which said wheel means further comprises a mounting bracket attached to said one end of said lift, said mounting bracket including a portion extending above said wheel arm; further in which said spring biasing means comprises a compression spring interposed between said portion of said mounting bracket and said wheel arm so that said wheel arm is urged apart from said portion of said mounting bracket, said spring having a lower end resting upon said wheel arm below the axis of rotation of said wheel.

6. The apparatus as recited in claim 5, in which said lower end of said spring rests on said wheel arm at a point between the pivotal attachment of said wheel arm and said axis of rotation of said wheel.

7. The apparatus as recited in claim 6, in which said wheel means has a first hole through said wheel arm and has a second hole through said portion of said mounting bracket, and said wheel means further comprises a bolt passing coaxially through said first hole, said spring, and said second hole, said bolt having a nut on the end thereof adjacent said portion of said mounting bracket, remote from said spring, for compressing said spring and thereby causing said wheel arm to pivot.

8. In combination, (a) a portable surface lift for a vehicle, said lift having a front end and a rear end;

(b) retractable wheel means attached to one of said front and rear ends of said lift for rolling movement of said lift over a surface; and (c) towing means, removably attachable to the other of said front and rear ends of said lift, for towing said other end of said lift, said lift including a towing bracket fixedly attached to said other end of said lift, said towing means being removably attachable to said towing bracket and being selected from the group consisting of:

(a) a modified automotive floor jack, said jack comprising a manually-operated lifting portion and a jack bracket bar securedly attached to said lifting portion for removable engagement with said towing bracket;

(b) a towing dolly, said towing dolly comprising:

i. a dolly bracket;

ii. engagement means attached to said dolly bracket for removable engagement with said towing bracket;

iii. a wheel attached for rotation to said towing dolly for rolling support of said towing dolly; and iv. a handle attached to said towing dolly for movement of said towing dolly; and (c) a towing apparatus, said towing apparatus comprising:

i. an elongated and substantially horizontal tube having a first end and a second end;

ii. a vertical towing pin slidably attached to said first end of said horizontal tube for removable engagement with said towing bracket;

iii. actuating means for vertical raising and lowering movement of said vertical pin, said actuating means comprising:

(a) a lever pivotally attached to said second end of said horizontal tube;

(b) a guide tube fixedly attached to said first end of said horizontal tube, said guide tube having a longitudinal bore within which said vertical pin slides;

(c) a pull rod linkage having a first end operably connected to said lever for longitudinal movement of said pull rod linkage in response to pivotal movement of said lever; and (d) translating means for translating the longitudinal movement of said pull rod linkage into the vertical movement of said vertical pin;

iv. a wheel attached for rotation to said towing apparatus for rolling support of said towing apparatus; and v. a handle attached to said second end of said horizontal tube for movement of said towing apparatus.

9. The apparatus as recited in claim 8, in which said pull rod linkage additionally has a second end, said translating means includes a first link member and a second link member, each said link member having a first end and a second end, said first ends of said first and said second link members being operably connected to said second end of said pull rod linkage, said second end of said first link member being pivotally attached to said guide tube, and said second end of said second link member being pivotally attached to said vertical pin.

10. The apparatus as recited in claim 8, in which said lever of said actuating means has an engaging position in which said vertical pin is raised and a disengaging position in which said vertical pin is lowered, and in which said towing apparatus additionally comprises keeper means for securing said lever in said engaging position.

11. The apparatus as recited in claim 8, in which said wheel means comprises:

(a) a wheel arm having a first and a second end, said wheel arm being pivotally attached at said first end thereof to said one end of said lift;

(b) a wheel rotatably attached to said second end of said wheel arm and in rolling contact with said surface; and (c) spring biasing means for causing said wheel arm to pivot when said vehicle is removed from said lift so that said one end of said lift is lifted off said surface.

12. The apparatus as recited in claim 11, in which said pull rod linkage additionally has a second end, said translating means includes a first link member and a second link member, each said link member having a first end and a second end, said first ends of said first and said second link members being operably connected to said second end of said pull rod linkage, said second end of said first link member being pivotally attached to said guide tube, and said second end of said second link member being pivotally attached to said vertical pin.

13. The apparatus as recited in claim 11, in which said lever of said actuating means has an engaging position in which said vertical pin is raised and a disengaging position in which said vertical pin is lowered, and in which said towing apparatus additionally comprises keeper means for securing said lever in said engaging position.

* * * * *